US010120305B1

(12) United States Patent
Carter et al.

(10) Patent No.: US 10,120,305 B1
(45) Date of Patent: Nov. 6, 2018

(54) FUSER INSTALLATION IN AN IMAGING DEVICE

(71) Applicant: LEXMARK INTERNATIONAL, INC., Lexington, KY (US)

(72) Inventors: Daniel Lee Carter, Lexington, KY (US); Mark Stephen Malone, Lexington, KY (US); Brian Anthony Reichert, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/728,588

(22) Filed: Oct. 10, 2017

(51) Int. Cl.
*G03G 15/20* (2006.01)
*G03G 21/16* (2006.01)

(52) U.S. Cl.
CPC ..... *G03G 15/2017* (2013.01); *G03G 21/1647* (2013.01); *G03G 21/1652* (2013.01); *G03G 21/1685* (2013.01); *G03G 2221/1651* (2013.01); *G03G 2221/1654* (2013.01); *G03G 2221/1657* (2013.01)

(58) Field of Classification Search
CPC ..... G03G 15/2017; G03G 21/1647; G03G 21/1652; G03G 21/1685; G03G 2221/1651; G03G 2221/1654; G03G 2221/1657
See application file for complete search history.

(56) References Cited

U.S. PATENT DOCUMENTS

2015/0168910 A1* 6/2015 Maul ..... G03G 21/1647 399/24

* cited by examiner

*Primary Examiner* — David M Gray
*Assistant Examiner* — Andrew V Do

(57) ABSTRACT

An imaging device has a drive gear assembly which operatively engages with a backup roll gear of a fuser assembly when the fuser assembly is inserted into the imaging device. Such engagement causes the drive gear assembly to rotate, and in turn rotates a drive motor coupled to the drive gear assembly. The drive motor includes Hall Effect sensors associated with a sensor arrangement that senses rotation of the motor. During rotation of the drive motor, sensor signals are transmitted to a controller of the imaging device, the controller counting rising and falling signal edges of the received sensor signals. Based on the number of rising and falling signal edges, a message is sent to a user of the imaging device whether or not the installation of the fuser assembly was successful.

20 Claims, 13 Drawing Sheets

FUSER INSTALLATION IN AN IMAGING DEVICE

FIELD OF THE EMBODIMENTS

The present disclosure relates generally to controlling a fuser assembly in an imaging device, and particularly to ensuring that the fuser assembly is fully inserted into its operable position within the imaging device. This includes properly installing the fuser assembly including a user message indicating same.

BACKGROUND

In an electrophotographic imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to a media sheet intended to receive the final image. The toner image is fixed to the media sheet by the application of heat and pressure in a fuser assembly. The fuser assembly may include a hot roll and a backup roll forming a fuser nip through which the media sheet passes. Alternatively, the fuser assembly may include a fuser belt, a heater disposed within the belt around which the belt rotates, and an opposing backup member, such as a backup roll. The backup roll, for either fuser belt or hot roll architectures, is typically driven and includes a shaft and gear coupled thereto. The backup roll gear engages with a drive gear located in the printer for receiving power from a motor, such as a brushless DC motor, disposed within the printer. Activating the motor causes the drive gear in the printer and the backup roll gear in the fuser assembly to rotate, which rotates the backup roll in the fuser assembly so as to pass a sheet of media through the nip of the fuser assembly for fusing recently transferred toner to the media sheet.

The brushless DC motor typically includes or is otherwise associated with a sensing arrangement coupled to the controller of the imaging device. The sensing arrangement senses motor position generated by Hall Effect sensors responsive to the motor magnets and provides the sensed motor position to the controller. The controller then performs motor commutation using the sensed motor position.

During fuser installation, it may not always be clear for new and even experienced users to know whether or not the fuser assembly is properly installed. Thus, a need exists to know when the fuser assembly is fully inserted to its operable position within the imaging device.

SUMMARY

The above-mentioned and other problems are solved by methods and apparatus for ensuring that a fuser assembly in an electrophotographic device has been properly installed. An imaging device includes a removable fuser assembly having a heat transfer member and a backup roll for forming a nip for conveying sheets of media therein and a drive gear connected to the backup roll and a drive gear assembly. The drive gear assembly includes at least one gear which operatively engages with the drive gear of the fuser assembly when the fuser assembly is in an operable position and rotates due to engagement with the drive gear during insertion of the fuser assembly into the operable position.

The imaging device further includes a drive motor coupled to the drive gear assembly to rotate the at least one gear and in turn to rotate the drive gear and the backup roll to feed the sheet of media through the fusing nip and a sensor arrangement configured about the drive motor to sense rotation of the drive motor and based thereon provide at least one sensor output signal. When the fuser assembly is inserted and moved toward the operable position, the drive gear engages the at least one gear of the drive gear assembly and in turn causes rotation of the drive motor. The imaging device also includes a controller to receive the at least one sensor output signal to determine whether or not the fuser assembly is fully inserted into the operable position. The controller then initiates a message to a user of the imaging device indicating same.

In another example embodiment, a method of installing a fuser assembly having a heat transfer member and a backup roll forming a nip for fusing sheets of media and a drive gear coupled to the backup roll, the imaging device further including an interface gear of a drive gear assembly connected to a drive motor, a sensor arrangement is configured to sense rotation of the drive motor and connected to a controller: rotating the interface gear and the drive motor coupled to the drive gear assembly upon initial insertion of the fuser assembly into the imaging device and engagement by the drive gear of the fuser assembly with the interface gear of the drive gear assembly, indicating by the sensor arrangement to the controller rotational movement of the drive motor, and determining by the controller whether enough rotational movement of the drive motor has occurred to conclude or not that the fuser assembly is in an operable position These and other embodiments are set forth in the description below. Their advantages and features will become readily apparent to skilled artisans. The claims set forth particular limitations.

and

Figure 11:
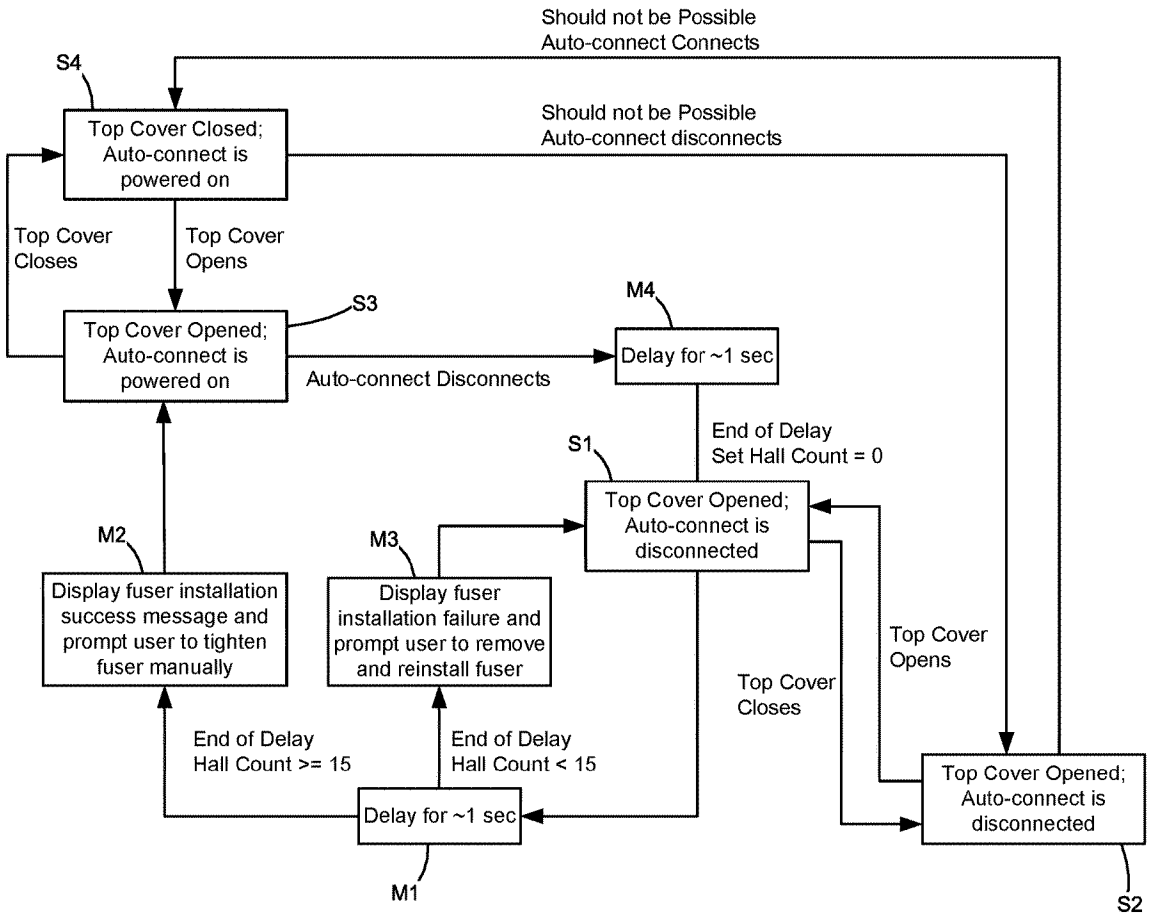

FIG. 11 is a state diagram illustrating the operation of installing the fuser assembly, according to an example embodiment.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that changes may be made without departing from the scope of the invention. The following detailed description, therefore, is not to be taken in a limiting sense and the scope of the invention is defined only by the appended claims and their equivalents.

Figure 1:
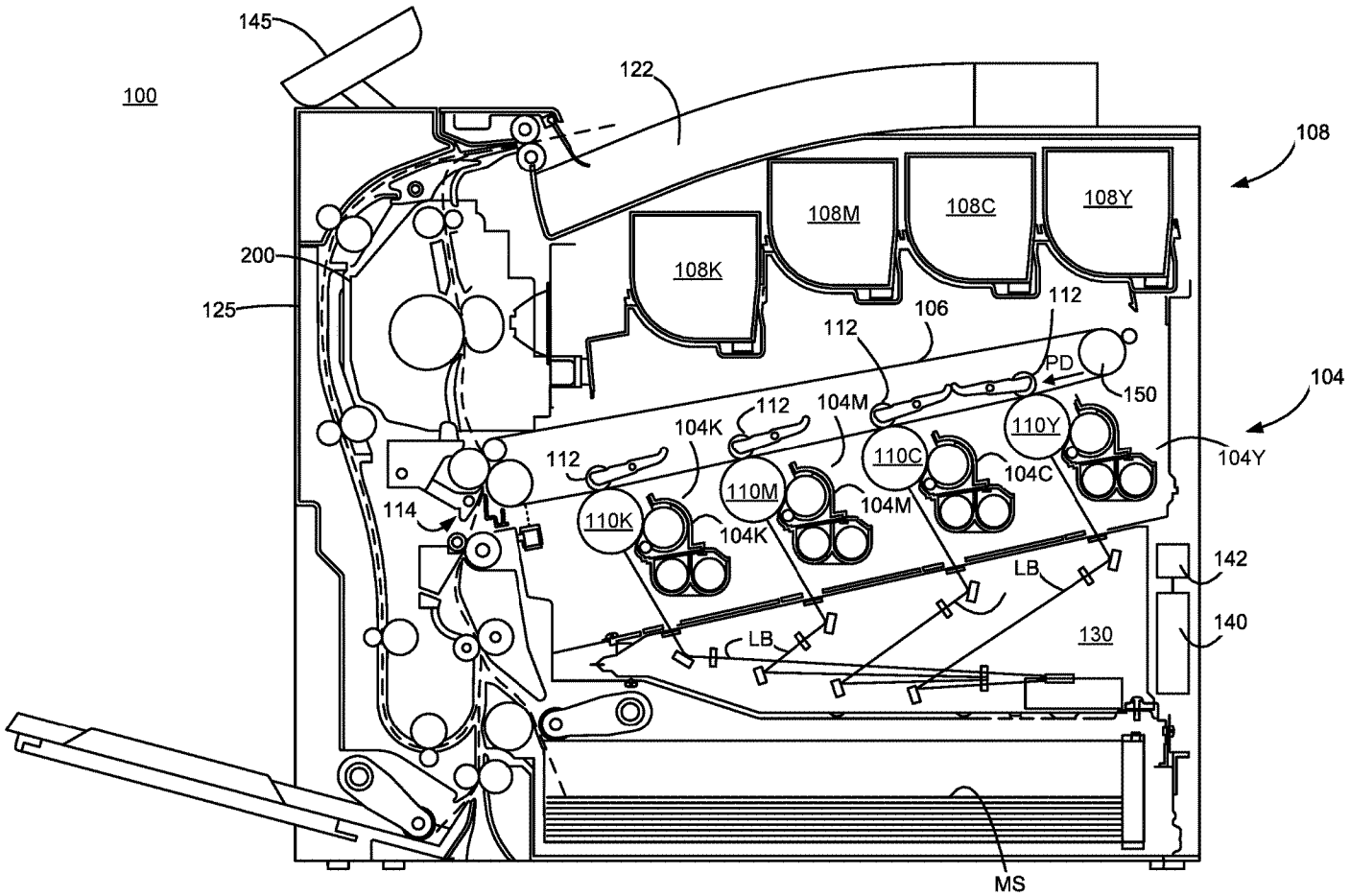
FIG. 1 is a schematic illustration of an imaging device including a fuser assembly according to an example embodiment.

FIG. 1 illustrates a color imaging device 100 according to an example embodiment. Imaging device 100 includes four developer units 104Y, 104C, 104M and 104K that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to a process direction PD of the ITM belt 106, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110Y, 110C, 110M and 110K that receives toner therefrom during toner development in order to form a toned image thereon. Each photoconductive member 110 is paired with a transfer member 112 for use in transferring toner to ITM belt 106.

ITM belt 106 is disposed adjacent to each of developer unit 104. In this embodiment, ITM belt 106 is formed as an endless belt. During image forming or imaging operations, ITM belt 106 moves past photoconductive members 110 in process direction PD as viewed in FIG. 1. One or more of photoconductive members 110 applies its toner image in its respective color to ITM belt 106. For mono-color images, a toner image is applied from a single photoconductive member 110K. For multi-color images, toner images are applied from two or more photoconductive members 110.

During color image formation, the surface of each photoconductive member 110 is charged to a specified voltage. At least one laser beam LB from a printhead or laser scanning unit (LSU) 130 is directed to the surface of each photoconductive member 110 and discharges those areas it contacts to form a latent image thereon. The developer unit 104 then transfers toner to photoconductive member 110 to form a toner image thereon. The toner is attracted to the areas of the surface of photoconductive member 110 that are discharged by the laser beam LB from LSU 130.

ITM belt 106 rotates and collects the one or more toner images from the one or more developer units 104 and then conveys the one or more toner images to a media sheet MS at a transfer area 114. Fuser assembly 200 is disposed downstream of transfer area 114 and receives media sheets MS with the unfused toner images superposed thereon. In general terms, fuser assembly 200 applies heat and pressure to the media sheets MS in order to fuse toner thereto. After leaving fuser assembly 200, a media sheet MS is either deposited into an output media area 122 for pickup or enters a duplex media path as is familiar. A cover 125 is provided on the front of imaging device 100 and movable between a closed position and an open position. Cover 125 allows user access into the interior of imaging device 100, for inserting and removing fuser assembly 200.

Imaging device 100 is depicted in FIG. 1 as a color laser printer in which toner is transferred to a media sheet MS in a two-step operation. Alternatively, imaging device 100 may be a color laser printer in which toner is transferred to a media sheet MS in a single-step process—from photoconductive members 110 directly to a media sheet MS. In another alternative embodiment, imaging device 100 may be a monochrome laser printer.

Imaging device 100 further includes a controller 140 and memory 142 communicatively coupled thereto. The controller 140 couples to components and modules in imaging device 100 for controlling same. For instance, controller 140 may be coupled to toner reservoirs 108, developer units 104, photoconductive members 110, fuser assembly 200 and/or LSU 130 as well as to motors for imparting motion thereto. It is understood that controller 140 may be implemented as any number of controllers and/or processors for suitably controlling imaging device 100 to perform, among other functions, printing operations. A user interface 145 may be located on the front of imaging device 100. User interface 145 is in operative communication with controller 140. Using the user interface 145, a user is able to enter commands and generally control the operation of imaging device 100.

Figure 2:
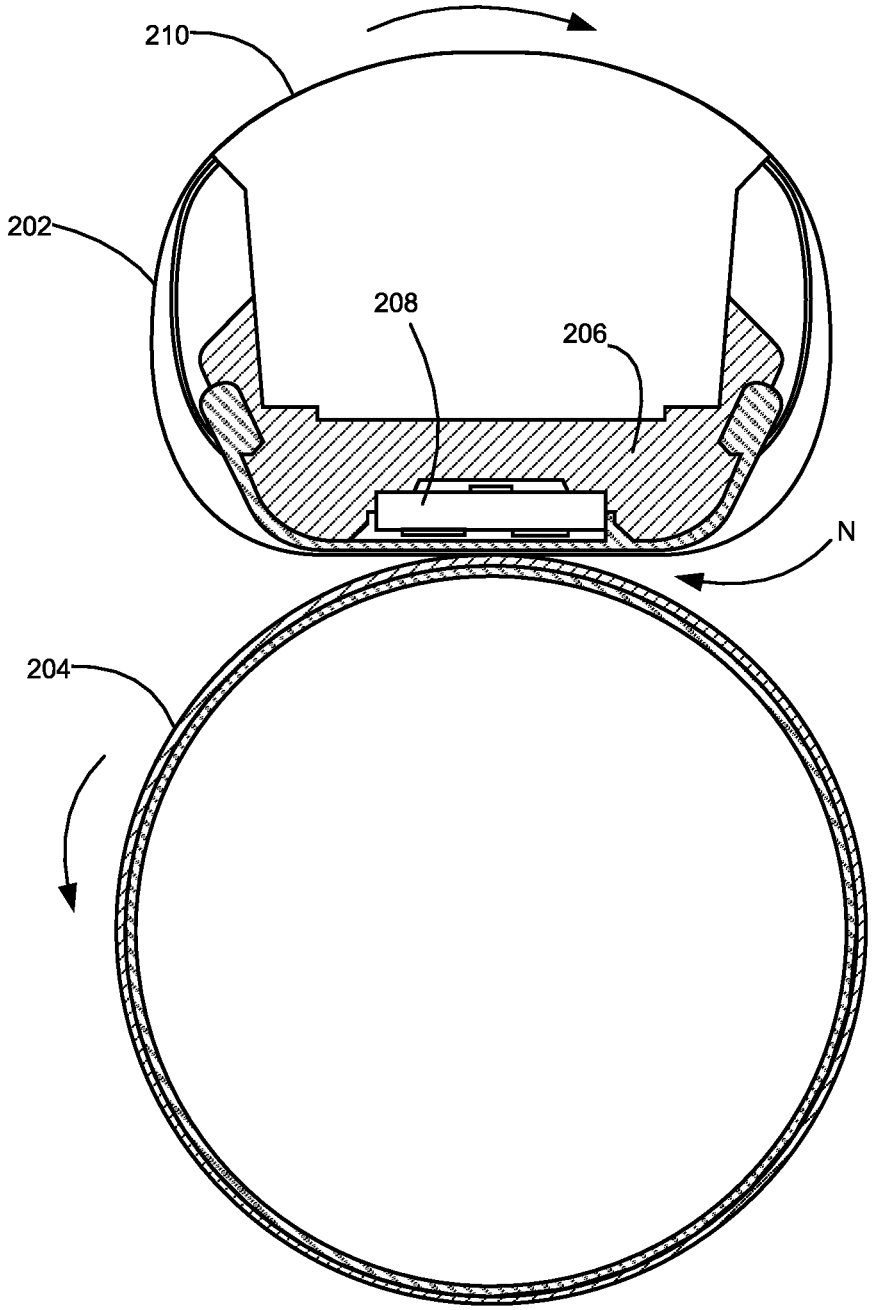
FIG. 2 is a diagrammatic view of a fuser assembly.

With respect to FIG. 2, in accordance with an example embodiment, there is shown a portion of the fuser assembly for use in fusing toner to sheets of media through application of heat and pressure. It includes a heat transfer member 202 and a backup roll 204 cooperating with the heat transfer member 202 to define a fuser nip N for conveying media sheets therein. The heat transfer member 202 may include a housing 206, a heater member 208 supported on or at least partially in housing 206, and an endless flexible fuser belt 210 positioned about housing 206. Heater member 208 may be formed from a substrate of ceramic or like material to which at least one resistive trace is secured which generates heat when a current is passed through it. The inner surface of fuser belt 210 contacts the outer surface of heater member 208 so that heat generated by heater member 208 heats fuser belt 210. It is understood that, alternatively, heater member 208 may be implemented using other heat-generating mechanisms.

Fuser belt 210 is disposed around housing 206 and heater member 208. Backup roll 204 contacts fuser belt 210 such that fuser belt 210 rotates about housing 206 and heater member 208 in response to backup roll 204 rotating. Backup roll 204 is rotatably coupled with a backup roll gear 222 (FIG. 4A) such that when backup roll gear 222 is rotated, backup roll 204 rotates as a result. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media.

It is understood though, that fuser assembly 200 may have a different fuser belt architecture or even a different architecture from a fuser belt based architecture. For example, fuser assembly 200 may be a hot roll fuser, including a heated roll and a backup roll engaged therewith to form a fuser nip through which media sheets traverse. The hot roll fuser may include an internal or external heater member for heating the heated hot roll. The hot roll fuser may further include a backup belt assembly. Hot roll fusers, with internal and external heating forming the heat transfer member with the hot roll, and with or without backup belt assemblies, are known in the art.

Figure 3:
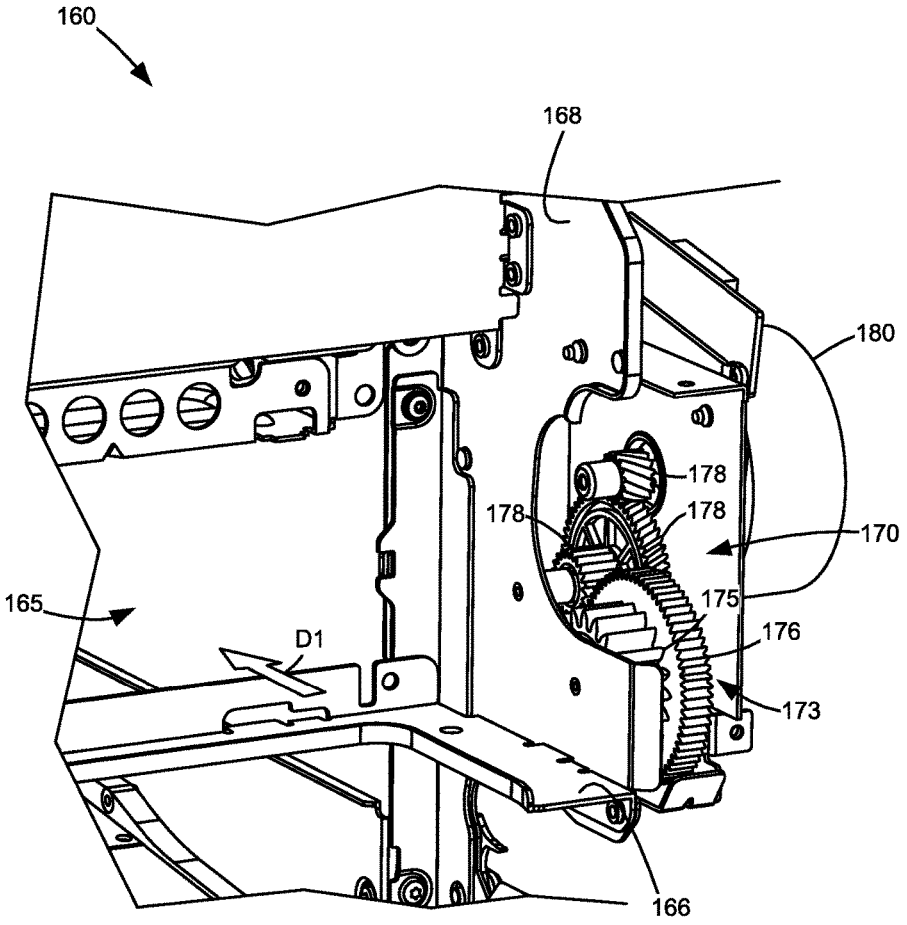
FIG. 3 is a perspective view of a frame of the imaging device having a drive gear assembly.

FIG. 3 is a perspective view of a frame 160 used to support various internal components within imaging device 100. Frame 160 includes an opening 165 defined by a base 166 and opposed side panels 168. Opening 165 is sized to receive fuser assembly 200 (FIG. 1) when fuser assembly 200 is being inserted in a direction D1. A drive gear assembly 170 is shown disposed at an end of frame 160. Drive gear assembly 170 includes a compound gear 173 having an interface gear 175 and a spur gear 176. Spur gear 176 may be engaged with a drive motor 180 for driving fuser assembly components or with at least one of the printer-side gears 178 coupled with the drive motor 180 as is known in the art. Drive motor 180 is coupled through suitable gearing and drive take-offs to provide multiple and differing drive rotations to rotating components of fuser assembly 200. It will be appreciated that the gears comprising drive gear assembly 170 may be comprised entirely of spur gears, helical gears, any other type of gear, or it may be a combination of different types of gears used to the same effect.

Figure 4A:
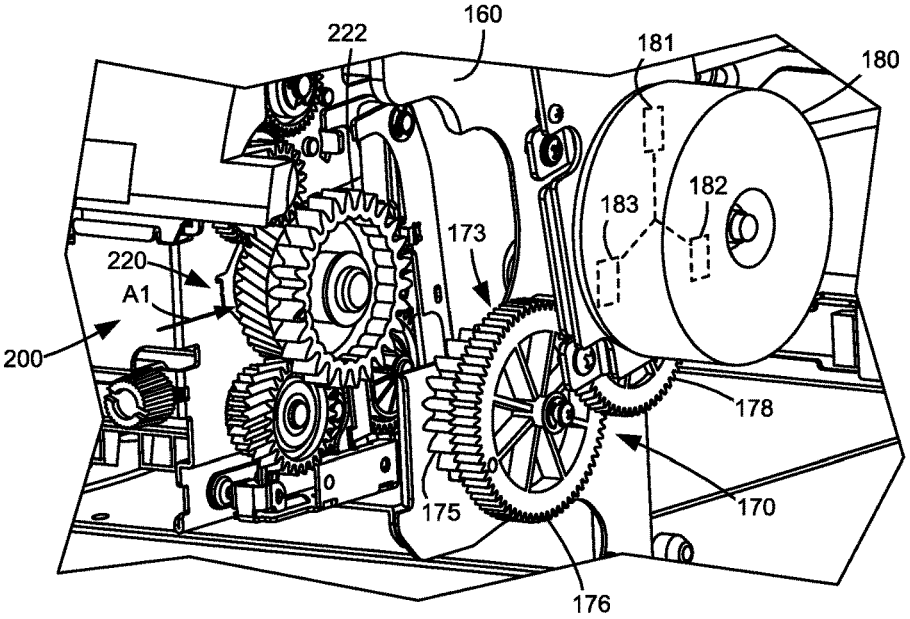
FIGS. 4A-4C are sequential views of installing the fuser assembly within the imaging device.
Figure 4B:
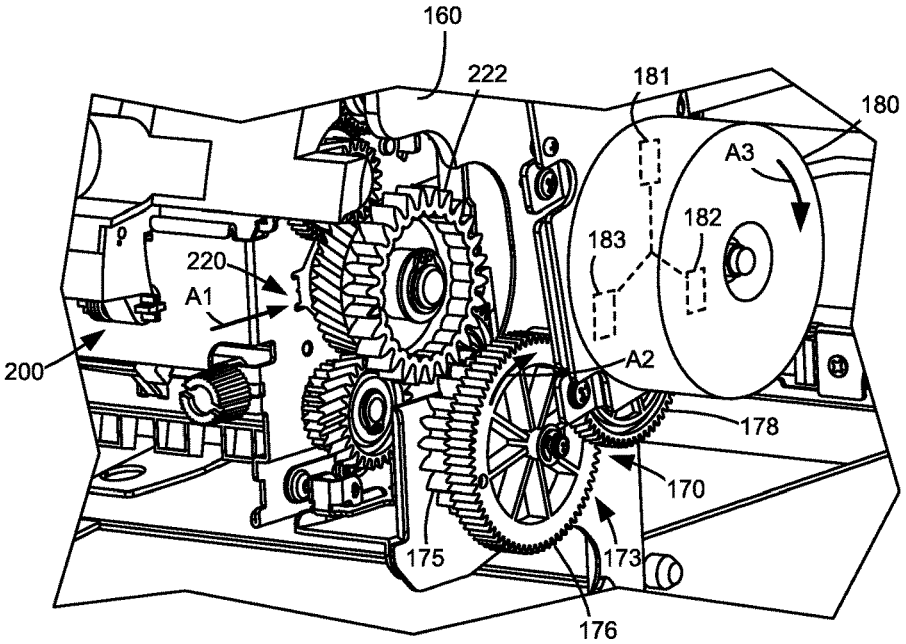
Figure 4C:
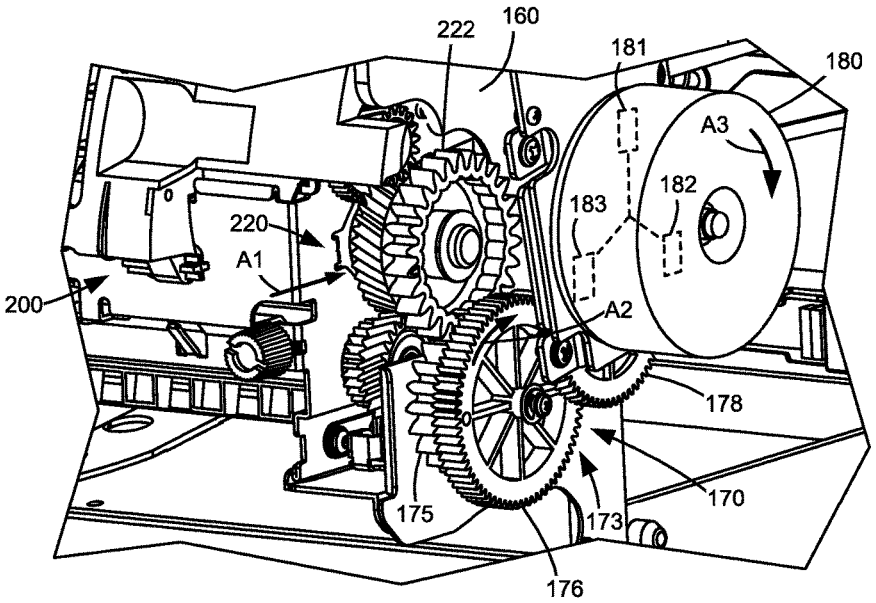
Figure 5A:
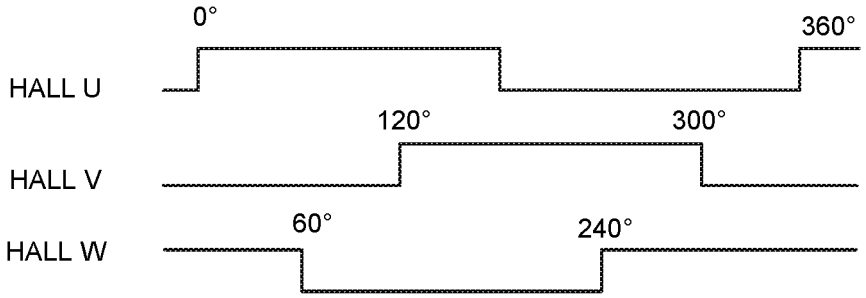
FIGS. 5A-5B are graphs showing representative Hall Effect signals based on an example sensor arrangement.
Figure 5B:
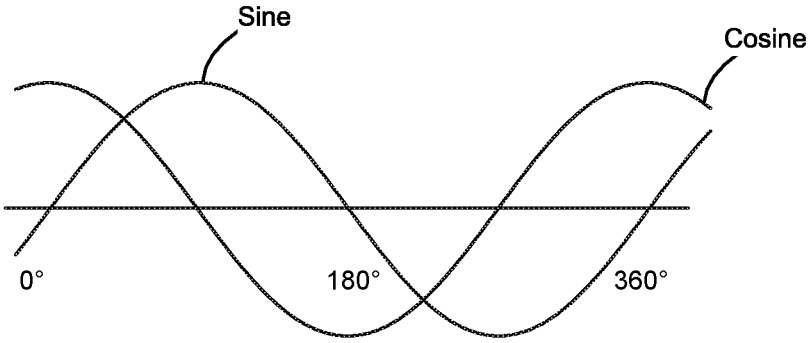

In the example embodiment shown in FIGS. 4A-4C, drive motor 180 is a brushless DC motor including a rotor having a plurality of permanent magnets and a stator having a plurality of windings. Hall Effect sensors 181, 182, and 183 are provided to sense the proximity of the drive motor's permanent magnets as a means of detecting motor position as is known in the art. Hall Effect sensors 181, 182, and 183 generate signals Hall U, Hall V, and Hall W based on a sensor arrangement, either in the stator windings, or assembled on a small printed circuit board (PCB), at 0°, 120°, and 240° locations opposite the rotor's permanent magnets. The resulting Hall U, Hall V, and Hall W signals generated by Hall Effect sensors 181, 182, and 183, respectively are shown in FIG. 5A. Another approach to detect motor position is to use three Hall Effect sensors and a signal conditioning that generates sine or cosine signals, as shown in FIG. 5B, based on a sensor arrangement where the angular position within a 360° rotation of the drive motor 180 is continuously available. A small permanent magnet is attached to the rotor axis and generates a rotating field which is picked up by a Hall Effect sensor bridge. All of the three Hall Effect sensors, the signal conditioning, and the sensor arrangement are integrated on one encoder IC. One skilled in the art would recognize that other sensor arrangements can be used to the same effects and the aforementioned sensor arrangements are not considered to be a limitation of the design.

FIGS. 4A-4C further show installation of fuser assembly 200 within imaging device 100. A drive train 220 is positioned at a first end of fuser assembly 200 for driving various rolls and components of fuser assembly 200. Drive train 220 is a plurality of intermeshed gears and includes the backup roll gear 222 positioned to operatively engage with the interface gear 175 of drive gear assembly 170 when fuser assembly 200 is inserted into imaging device 100. While the exemplary embodiment of drive train 220 is a gear train, those skilled in the art will understand that drive train 220 may include a series of interconnected gears, a belt drive system of belts and pulleys or a combination of belts, pulleys, and gears.

Figure 10:
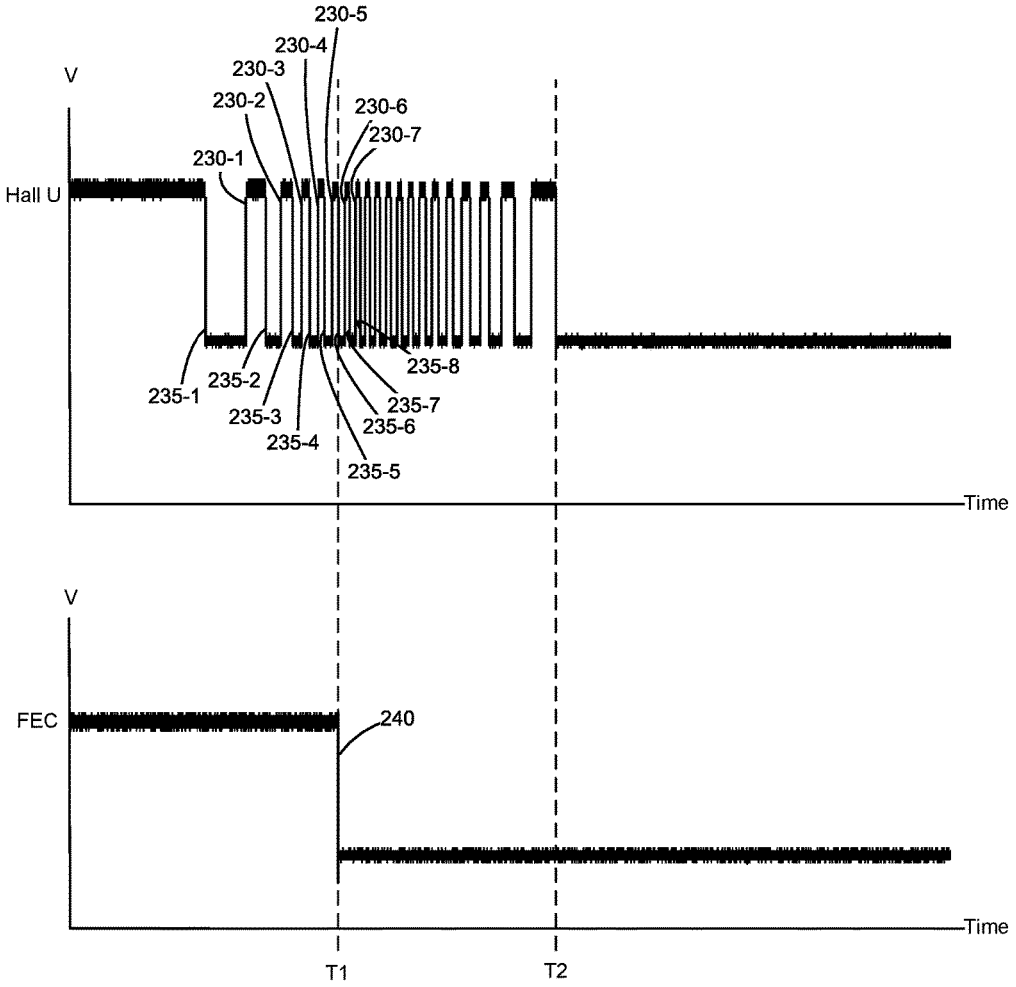
FIG. 10 is a timing diagram graph showing varying electrical signals from Hall Effect sensors and the autoconnect of the fuser assembly over time according to an example embodiment.

In FIG. 4A, fuser assembly 200 is shown inserted towards its operable position as indicated by the arrow A1. When fuser assembly 200 is in the operable position, fuser assembly 200 is determined to be correctly installed within imaging device 100 and communicatively coupled to controller 140 (FIG. 1). Referring to FIG. 4B, as fuser assembly 200 continues to be inserted towards its operable position, backup roll gear 222 engages with interface gear 175 causing spur gear 176 to rotate forward as indicated by the arrow A2. Consequently, spur gear 176 cranks the printer-side gears 178 connected to drive motor 180. In turn, drive motor 180 is rotated forward as indicated by the arrow A3 as a result of the rotation of the printer-side gears 178. Further, pressure between the backup roll 204 and fuser belt 210, as shown in FIG. 2, provides a high resistive torque for the drive train 220 such that the backup roll gear 222 does not rotate during engagement with interface gear 175. Rather, only interface gear 175 rotates. Although the backup roll gear 222 is shown engaging with the interface gear 175, those skilled in the art will understand that any of the gears in the drive train 220 may engage with the printer-side gears 178 when fuser assembly 200 is inserted to its operable position resulting in the rotation of drive motor 180 as a result. Due to the rotation of drive motor 180 and the permanent magnets passing by the Hall Effect sensors 181, 182, 183, output signals from Hall Effect sensors 181, 182, 183 rise to a relatively high voltage or fall to a relatively low voltage. For example, as shown in FIG. 10, Hall Effect sensor signal Hall U from Hall Effect sensor 181 is illustrated as a waveform having rising and falling signal edges. Rising signal edges represent transitions from a lower voltage towards a higher voltage, such as shown in rising signal edges 230 of Hall Effect sensor signal Hall U. Moreover, falling signal edges represent transitions from a higher voltage towards a lower voltage, such as shown in falling signal edges 235 of Hall Effect sensor signal Hall U. Each output signal from Hall Effect sensors 181, 182, 183 is then transmitted to the controller 140 of the imaging device 100 for determining motor position and proper installation. Based on empirical data, the inventors have concluded that for the proper installation of the fuser assembly 200 within imaging device 100, there needs to be a least fifteen rising and falling signal edges 230, 235 to guarantee that fuser assembly 200 is in its operable position. That is, rising signal edges 230-1 to 230-7 and falling signal edges 235-1 to 235-8, as shown in FIG. 10, are sequential counts having a total combined number of fifteen rising and falling signal edges, indicating proper fuser installation. Further, other designs could contemplate other than 15 rising and falling signal edges.

Referring back to FIG. 4C, fuser assembly 200 is shown as having been fully inserted to its operable position such that during a print operation, motor assembly 180 is activated causing backup roll 204 of fuser assembly 200 to rotate. When fuser assembly 200 has been successfully moved to its operable position, a message indicating success of fuser installation is sent to the user either visually, auditorily, or both via user interface 145.

Figure 6:
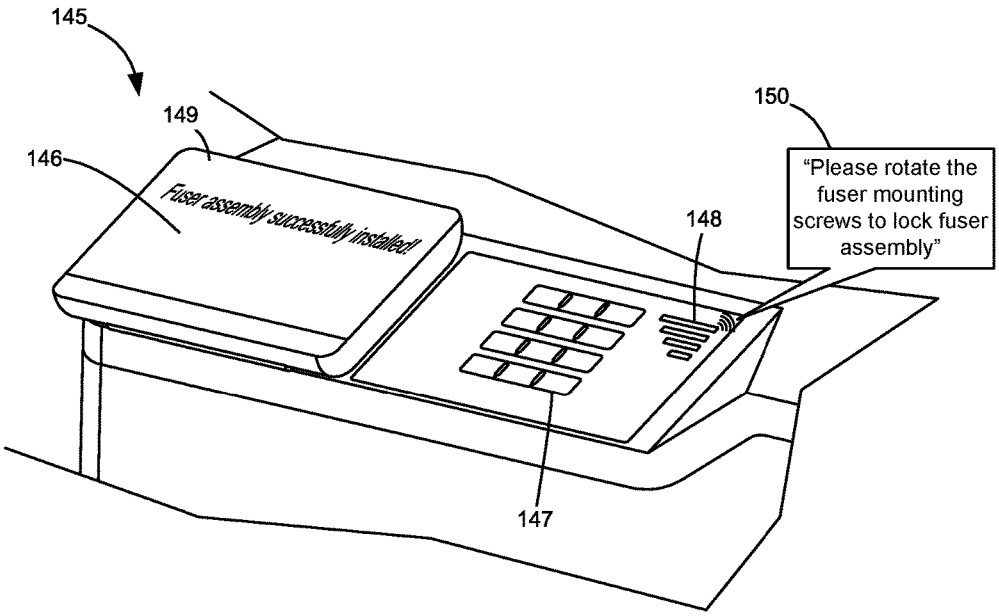
FIG. 6 is a perspective view of a user interface having a speaker on the imaging device including user messaging.

As seen in FIG. 6, user interface 145 includes a display 146, a key panel 147, and a speaker 148. Once controller 140 confirms that fuser assembly 200 is in its operable position, it causes user interface 145 to display a message 149 on the display 146 or provide an audible message 150 through speaker 148, or both. Such message informs the user that the fuser assembly has been installed correctly within imaging device 100. Conversely, when the fuser assembly is not installed correctly, the controller controls user interface 145 to display a message on the display 146 or provide an audible message through speaker 148, or both, informing the user that the fuser assembly must be removed and reinstalled into the imaging device, for example.

Figure 7A:
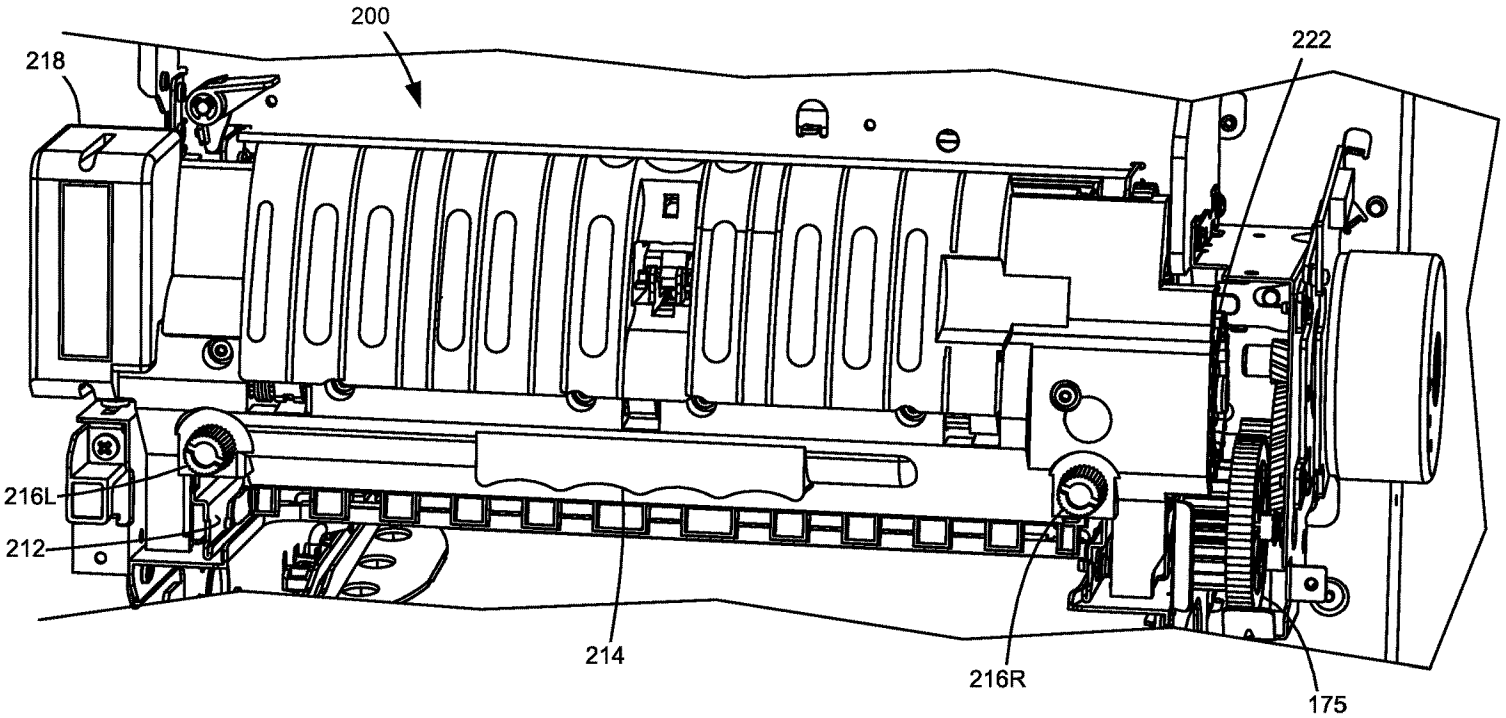
FIGS. 7A and 7B are front and rear perspective views of the fuser assembly, respectively, when the fuser assembly is installed within the imaging device.
Figure 7B:
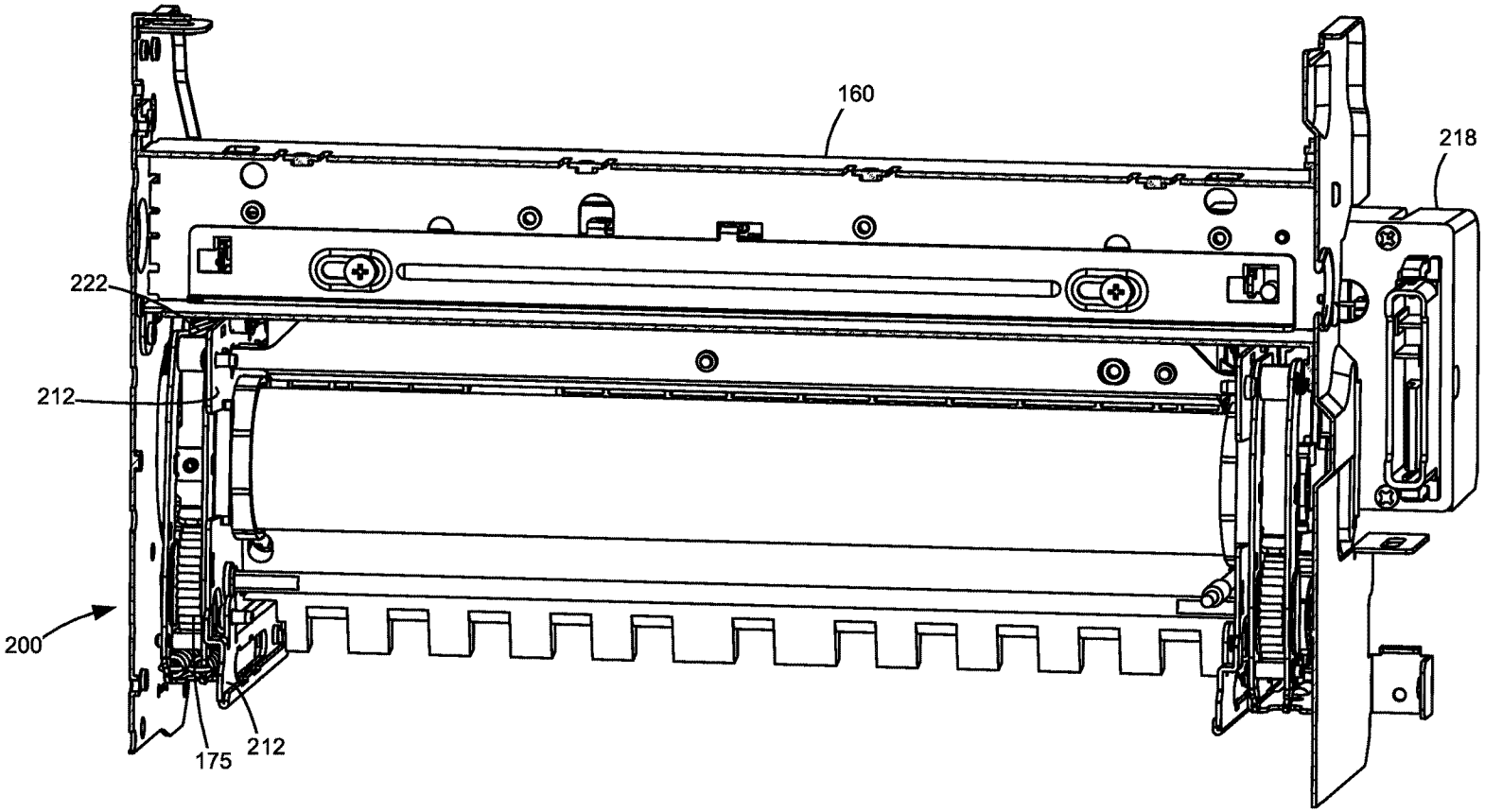

In FIGS. 7A-7B, front and rear perspective views show a properly installed in imaging device 100 as it resides in its operable position. Fuser assembly 200 also includes a fuser frame 212 forming a supporting structure for hosting additional features of the fuser assembly 200. Namely, a hand grip 214 is mounted on a front portion of the fuser assembly 200 for users to utilize in pulling and pushing the fuser assembly 200. An electrical connector or autoconnect 218 is shown mounted on a second end portion of fuser assembly 200 for establishing an electrical connection between fuser assembly 200 and an electrical connector port 219 (FIG. 9A-9B) in imaging device 100. When fuser assembly 200 is in its operable position, autoconnect 218 establishes the electrical connection by mating with the electrical connector port 219 of the imaging device. Such electrical connection provides power to the fuser assembly and to an electrical communication interface between the fuser assembly 200 and the imaging device 100, particularly controller 140, for transmitting and receiving information therebetween. Further, a fuser exit check signal is sent to controller 140 for detecting whether fuser assembly 200 has been fully inserted or removed. Fuser mounting screws 216L, 216R are mounted on opposite sides of the fuser assembly 200 and comprise a locking mechanism such that activating or manually rotating the locking mechanism by a user locks in place the fuser assembly within imaging device 100. As before, when fuser assembly 200 becomes seated in its operable position, a user message is sent informing the user of proper installation of fuser assembly 200, but may also include user messaging to rotate and lock the fuser mounting screws 216L, 216R.

Figure 8:
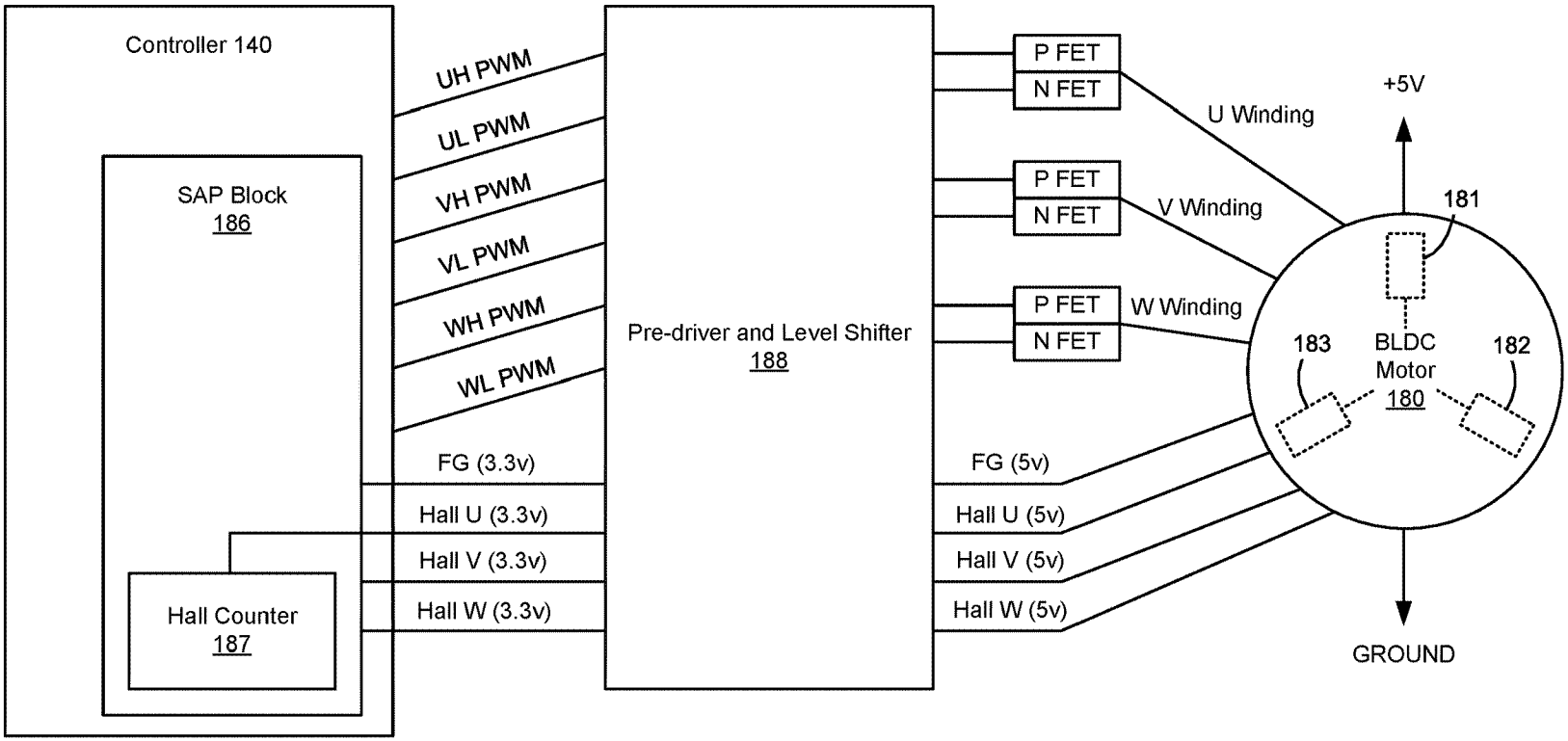
FIG. 8 is a schematic view of Hall Effect sensors as they are connected to a BLDC motor and a controller of the imaging device.

With reference to FIG. 8, a schematic view shows the Hall Effect sensors 181, 182, and 183 as they are connected to the drive motor 180 and other circuitry in imaging device 100. As noted, the imaging device further includes a predriver and level shifter 188, and a voltage and ground source for variously commonly powering and grounding the controller 140, the predriver and level shifter 188, the motor assembly 180, and other components. In the example embodiment, three stator windings U, V, W are shown connected to drive motor 180 such that applying current to any of the three stator windings U, V, W creates a magnetic field that attracts the rotor of drive motor 180 to a new position. In an example embodiment, the three stator windings U, V, and W are connected to each other in a 'WYE' configuration.

Output from the drive motor 180, and connected to controller 140 and predriver and level shifter 188, are three typical Hall Effect sensor signals Hall U, Hall V, and Hall W and an encoder field generation signal FG. In the example embodiment, the output voltage generated by the permanent magnets of the rotor of drive motor 180 passing over each of the Hall Effect sensors 181, 182, 183 varies between the ground and +5 volts. Output from the drive motor 180, particularly the Hall Effect sensor signals Hall U, Hall V, Hall W and the encoder field generation signal FG, are converted by the predriver and level shifter 188 to a compatible voltage that controller 140 uses to operate. In the example embodiment, each output voltage of the Hall Effect sensor signals Hall U, Hall V, Hall W and the encoder field generation signal FG from the drive motor 180 is shifted by the predriver and level shifter 188 from +5 volts to +3.3 volts. As is typical with brushless DC motors, the Hall Effect sensors 181, 182, 183 provide discrete signals indicative of the six states of the motor, to indicate position. The order of occurrence of these states is dependent on motor construction and direction. In a common embodiment, the discrete signals are six sensor states and correspond to logic high or low given per Hall Effect sensor signal Hall U, Hall V, Hall W as 0,0,1; 0,1,0; 0,1,1; 1,0,0; 1,0,1; and 1,1,0 respectively. As known in the art, however, these are not the actual order of occurrence but are representatively provided in this order according to binary counting. Then, controller 140 commutates the drive motor 180 according to the motor position between the six sensor states.

Controller 140 also includes a SAP block 186, also known as the motor control logic, for commutating and determining the position of drive motor 180, among other things. In the example embodiment, SAP block 186 receives the encoder FG signal from drive motor 180. In turn, it calculates a PWM in duty cycle for commutating drive motor 180. Such calculation is known in the art. The calculated PWM is altered via a multiplier per a given position. Then, the controller 140 creates six output signals UH PWM, UL PWM (HI and LO for the U winding), VH PWM, VL PWM (HI and LO for the V winding), and WH PWM, WL PWM (HI and LO for the W winding) serving as inputs to predriver and level shifter 188 to create output signals per winding that are either a logic low or high. Each of the three windings U, V, and W has a corresponding switch, particularly a CMOS type of switch which uses a P-MOS FET and an N-MOS FET. Each respective P-MOS FET of the three windings U, V, and W includes a connection to a positive voltage value and such is on the order of about +24V. Each respective N-MOS FET of the three windings U, V, and W includes a ground connection that corresponds to the ground of imaging device 100. During use, the P-MOS and N-MOS FETs of each of the three windings U, V, and W are switched on and off according to the received output signals from the predriver and level shifter 188 to commutate the drive motor 180. SAP block 186 also includes a hall counter 187 which counts both rising and falling signal edges of Hall Effect sensor signal Hall U, which can be seen as 230 and 235, respectively, in FIG. 10, for determining proper installation of fuser assembly 200. It will be understood that one skilled in the art would recognize that the other Hall Effect sensor signals Hall V and Hall W can be utilized to the same effects Hall Effect sensor signal Hall U is used in the present invention and is not considered to be a limitation of the design.

Figure 9A:
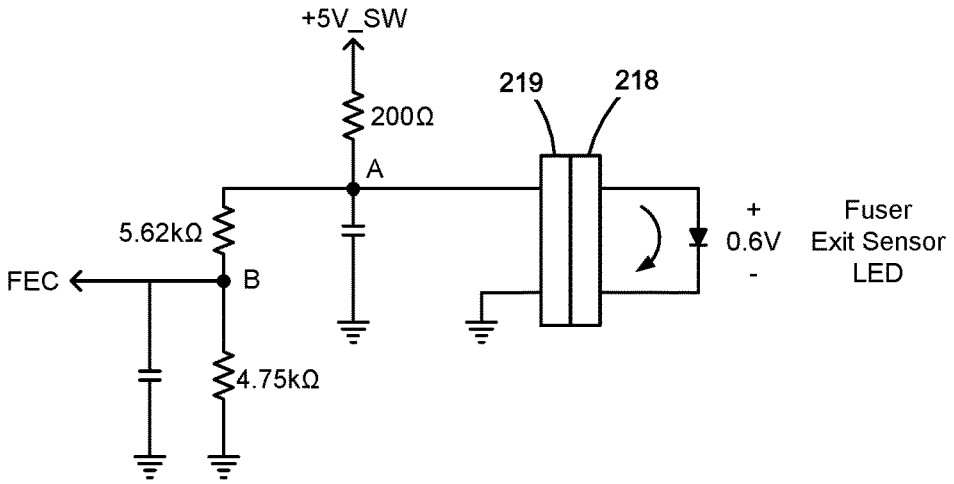
FIGS. 9A and 9B show respective circuitries for a fuser exit check signal when an autoconnect of the fuser assembly is powered on and off, respectively.
Figure 9B:
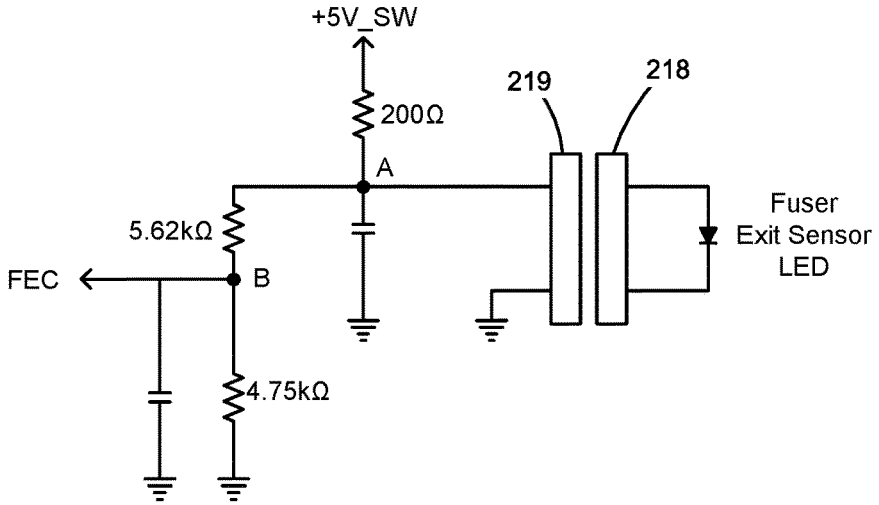

FIGS. 9A-9B show respective voltage differences of a fuser exit check signal when the autoconnect 218 of FIGS. 7A-7B is powered on and off. In FIG. 9A, autoconnect 218 is powered on by mating with the electrical connector port 219 of imaging device 100 such that the current flows through a fuser exit sensor LED resulting in a voltage decrease at point B. As a result, the voltage at point A is ~0.6 volts and the voltage at point B is 0.275 volts. When autoconnect 218 is powered on, the fuser exit check signal FEC should transition from a higher voltage towards a lower voltage, as illustrated in FIG. 10 by the falling edge 240 of fuser exit check signal FEC. In FIG. 9B, autoconnect 218 is powered off by disconnecting the autoconnect 218 from the electrical connector port 219 of imaging device 100 such that no current flows in the fuser exit sensor LED resulting in a higher voltage at point B. As a result, the voltage at point A is ~0.5 volts and the voltage at point B is ~2.29V. When autoconnect 218 is powered off, the fuser exit check signal should transition from a lower voltage towards a higher voltage.

As has been described somewhat earlier, FIG. 10 illustrates an example timing diagram showing waveforms of the Hall Effect sensor signal Hall U and a fuser exit check signal FEC during insertion of fuser assembly 200. Insertion of fuser assembly 200 causes drive motor 180 to rotate such that at time T1, rising signal edges 230-1 to 230-5 and falling signal edges 235-1 to 235-5 of Hall Effect sensor signal Hall U have occurred. In the example embodiment, voltage from each rising signal edge 230 transitions from 0 volts to about 5 volts. On the other hand, voltage from each falling signal edge 235 transitions from about 5 volts to 0 volts. Further, at time T1, autoconnect 218 is powered on as shown by the falling edge 240 of fuser exit check signal FEC. After time T1 has passed, drive motor 180 continues to rotate causing rising signal edges 230-6 to 230-7 and falling edges 235-6 to 235-8 to occur. At this point, a total of fifteen rising and falling signal edges have occurred. However, drive motor 180 still continues to rotate until it comes to a stop at time T2, wherein a total of 39 rising and falling signal edges has occurred. This also describes that even when autoconnect 218 has already been powered on, fuser assembly 200 cannot be said to be installed correctly. Then, a user message indicating same is sent to the user. Only when autoconnect 218 is powered on and at least fifteen rising and falling signal edges from Hall Effect sensor signal Hall U can fuser assembly 200 be said to be correctly installed and determined to be in position to be locked in place.

Referring to FIG. 11, a state diagram describing the operation of installing fuser assembly 200 is shown having four states S1-S4. When in the first state S1, cover 125 (FIG. 1) of imaging device 100 is opened and autoconnect 218 (FIG. 7A) is disconnected. First state S1 may either transition towards second state S2 when cover 125 of imaging device 100 is in the closed position or towards third state S3 when autoconnect 218 is powered on. When in the second state S2, cover 125 of imaging device 100 is opened and autoconnect 218 is disconnected. Second state S2 is only able to transition towards first state S1 whenever the cover 125 of imaging device 100 is opened. For the first state S1 to transition towards third state S3, a first delay of about 1 second is performed at M1 to ensure that the drive motor 180 has come to a complete stop such that controller 140 is able to accurately receive at least fifteen signal edges from Hall Effect sensor signal Hall U. If controller 140 is able to receive at least fifteen signal edges or more, at M2, controller 140 controls user interface 145 to display a message that informs the user that fuser assembly 200 has been installed correctly and instructs the user to manually lock the fuser assembly 200 within imaging device 100. Otherwise, at M3, user interface 145 displays a message that informs the user that fuser assembly 200 has not been installed properly and that fuser assembly 200 should be removed and reinstalled correctly. Consequently, first state S1 does not transition towards third state S3 and instead continues operation in the first state S1.

When in the third state S3, cover 125 of fuser assembly 200 is opened and autoconnect 218 is powered on. Third state S3 may either transition towards fourth state S4 when cover 125 of imaging device 100 is closed or towards first state S1 when autoconnect 218 is disconnected. During the transition from third state S3 towards first state S1, a second delay of about 1 second is performed at M4 to ensure that the drive motor 180 has come to a complete stop such that controller 140 correctly resets the total number of signal edges counted by hall counter 187 to 0. In the fourth state S4, cover 125 of imaging device 100 is closed and autoconnect 218 is powered on. Fourth state S4 is only able to transition towards third state S3 whenever the cover 125 of imaging device 100 is opened. Further, when in the fourth state S4, autoconnect 218 could not be disconnected while cover 125 of imaging device 100 is closed, thus disabling the transition from the fourth state S4 towards second state S2. This also applies to transitioning from the second state S2 to the fourth state S4 wherein autoconnect 218 could not be connected while the cover 125 of imaging device 100 is closed.

The foregoing illustrates various aspects of the invention. It is not intended to be exhaustive. Rather, it is chosen to provide the best illustration of the principles of the invention and its practical application to enable one of ordinary skill in the art to utilize the invention. All modifications and variations are contemplated within the scope of the invention as determined by the appended claims. Relatively apparent modifications include combining one or more features of various embodiments with features of other embodiments. All quality assessments made herein need not be executed in total and can be done individually or in combination with one or more of the others.

The invention claimed is:

1. An imaging device, comprising:

a fuser assembly for fusing toner to a sheet of media, the fuser assembly including a heat transfer member, a backup roll engaged therewith to define a fusing nip, and a drive gear connected to the backup roll such that the backup roll rotates when the drive gear rotates, the fuser assembly being removable from the imaging device;

a drive gear assembly having at least one gear which operatively engages with the drive gear of the fuser assembly when the fuser assembly is in an operable position, the at least one gear rotating due to engagement with the drive gear of the fuser assembly during insertion of the fuser assembly into the operable position;

a drive motor coupled to the drive gear assembly to rotate the at least one gear and in turn to rotate the drive gear and the backup roll of the fuser assembly to feed the sheet of media through the fusing nip;

a sensor arrangement configured about the drive motor to sense rotation of the drive motor and based thereon provide at least one sensor output signal, when the fuser assembly is inserted and moved toward the operable position, the drive gear of the fuser assembly engages the at least one gear of the drive gear assembly and in turn causes rotation of the drive motor; and a controller to receive the at least one sensor output signal to determine whether or not the fuser assembly is fully inserted into the operable position and to initiate a message to a user of the imaging device indicating same.

2. The imaging device of claim 1, further comprising a user interface communicatively coupled with the controller for providing the message to the user.

3. The imaging device of claim 2, wherein the user interface includes a speaker and the message is an audio message generated by the speaker.

4. The imaging device of claim 2, wherein the user interface includes a display and the message is a visual message displayed on the display.

5. The imaging device of claim 1, wherein the message indicates whether the fuser assembly is in the operable position.

6. The imaging device of claim 1, further comprising a locking mechanism associated with the fuser assembly to lock the fuser assembly in the operable position.

7. The imaging device of claim 6, wherein when the fuser assembly is in the operable position, the message instructs the user to manually activate the locking mechanism.

8. The imaging device of claim 1, wherein the message indicates that the fuser assembly is not in the operable position and instructs the user to remove and reinstall the fuser assembly.

9. The imaging device of claim 1, wherein the controller determines that the fuser assembly is in the operable position upon the controller detecting at least a predetermined number of rising and falling signal edges of the at least one sensor output signal during a predetermined period of time when the drive motor is not activated.

10. The imaging device of claim 9, wherein the predetermined number of rising and falling signal edges is 15.

11. The imaging device of claim 1, wherein the drive gear of the fuser assembly does not rotate during installation of the fuser assembly into the operable position thereof.

12. The imaging device of claim 1, further comprising an electrical connector port and the fuser assembly includes an electrical connector which mates with the electrical connector port when the fuser is in the operable position for providing at least one of power to the fuser assembly and an electrical communication interface to the fuser assembly.

13. A method of installation of a fuser assembly in an imaging device, the fuser assembly having a heat transfer member and a backup roll forming a nip for fusing sheets of media and a drive gear coupled to the backup roll, the imaging device further including an interface gear of a drive gear assembly connected to a drive motor, a sensor arrangement is configured to sense rotation of the drive motor and connected to a controller, the method comprising:

upon initial insertion of the fuser assembly into the imaging device and engagement by the drive gear of the fuser assembly with the interface gear of the drive gear assembly, rotating the interface gear and the drive motor coupled to the drive gear assembly;

indicating by the sensor arrangement to the controller rotational movement of the drive motor; and determining by the controller whether enough rotational movement of the drive motor has occurred to conclude or not that the fuser assembly is in an operable position.

14. The method of claim 13, further comprising messaging to a user whether or not the fuser assembly is in the operable position.

15. The method of claim 13, wherein the indicating includes providing from the sensor arrangement to the controller an output signal having rising and falling signal edges.

16. The method of claim 15, wherein the determining further includes counting whether the total number of rising and falling signal edges is greater than or equal to a predetermined value.

17. The method of claim 16, wherein when the total number of rising and falling signal edges is greater than or equal to the predetermined value, messaging a user of the imaging device to lock the fuser assembly within the imaging device.

18. The method of claim 16, wherein when the total number of rising and falling signal edges is less than the predetermined value, messaging a user of the imaging device to remove and reinstall the fuser assembly.

19. The method of claim 13, further comprising preventing rotation of the drive gear of the fuser assembly upon the initial insertion of the fuser assembly into the imaging device and said engagement by the backup roll with the interface gear of the drive gear assembly.

20. The method of claim 13, further comprising mating an electrical connector port of the imaging device to an electrical connector of the fuser assembly when the fuser assembly is in the operable position for providing at least one of power to the fuser assembly and an electrical communication interface to the fuser assembly.

* * * * *